US006709249B1

(12) United States Patent
Sun

(10) Patent No.: US 6,709,249 B1
(45) Date of Patent: Mar. 23, 2004

(54) RECESS ON TIP OF HYBRID SCROLL COMPRESSOR WRAP TO COMPENSATE FOR UNEVEN THERMAL EXPANSION

(75) Inventor: Zili Sun, Arkadelphia, AR (US)

(73) Assignee: Scroll Technologies, Arkadelphia, AK (US)

( * ) Notice: Subject to any disclaimer, the term of this patent is extended or adjusted under 35 U.S.C. 154(b) by 0 days.

(21) Appl. No.: 10/345,545

(22) Filed: Jan. 16, 2003

(51) Int. Cl.[7] ..... F04C 18/04
(52) U.S. Cl. ..... 418/55.2
(58) Field of Search ..... 418/55.2

(56) References Cited

U.S. PATENT DOCUMENTS 5,318,424 A * 6/1994 Bush et al. ..... 418/55.2
5,421,707 A * 6/1995 Daniels ..... 418/55.2
5,458,471 A * 10/1995 Ni ..... 418/55.2

* cited by examiner

*Primary Examiner*—John J. Vrablik
(74) *Attorney, Agent, or Firm*—Carlson, Gaskey & Olds

(57) ABSTRACT

A scroll compressor is provided with a hybrid having thicker wrap portions and thinner wrap portions. The problem of uneven thermal expansion is addressed by providing a recess in the thicker portion. The recess communicates with the inner higher pressure and higher temperature compression chambers to communicate the higher temperature refrigerant along the face of the thicker portion. The recess blocks flow of this refrigerant to the radially outer end of the thicker portion which communicates with a lower pressure/lower temperature chamber. The use of the recess compensates for uneven thermal expansion by bringing the thicker portion to a more even temperature across its width.

12 Claims, 2 Drawing Sheets

RECESS ON TIP OF HYBRID SCROLL COMPRESSOR WRAP TO COMPENSATE FOR UNEVEN THERMAL EXPANSION

BACKGROUND OF THE INVENTION

This invention relates to the provision of a shallow recess communicating discharge pressure and temperatures back across the width of a thicker portion of a hybrid wrap in a scroll compressor to compensate for the uneven thermal expansion that can occur in hybrid scroll wraps.

Scroll compressors are becoming widely utilized in refrigerant compression applications. In a scroll compressor, a first scroll member has a base with a generally spiral wrap extending from the base. A second scroll member has its own base and spiral wrap. The two wraps interfit to define compression chambers. One of the two scroll members is caused to orbit relative to the other, and as the relative orbital movement occurs, the wraps move reducing the size of the compression chambers, thus compressing an entrapped refrigerant.

Scroll compressors are becoming widely utilized due to their efficiency, and other beneficial characteristics. Also, a good deal of engineering development is occurring with scroll compressors. As one major advancement, the shape of the wraps has deviated from a spiral. Originally, the scroll wraps were formed generally along an involute of a circle. However, more recently, more complex shapes to the wraps have been developed. While the wraps are still "generally spiral," they do deviate from an involute of a circle. Various combinations of curves, involutes, etc. are utilized to form a so-called "hybrid" wrap. In a hybrid wrap, the width of the wrap varies along its circumferential dimension. Generally, in a non-hybrid wrap, the width of the wrap is uniform.

While hybrid wraps provide a number of benefits, they also raise a few challenges. One challenge is shown in prior art FIGS. 1 and 2. As shown in FIG. 1, a scroll compressor 20 has an orbiting scroll member 22 with a base 24 and a hybrid wrap 26. The non-orbiting scroll 28 has its own base 32 and wrap 33. As shown, the wrap 33 has thinner portions 30 and thicker portions 34. The reasons for, and configuration of, the hybrid wrap are known in the art. However, a problem associated with the wraps having thicker and thinner portions is illustrated in FIGS. 1 and 2. As shown, there is a relatively low pressure and low temperature suction chamber 38 on one side of the thicker wrap portion 34, and a higher pressure and temperature chamber 40 on the other. The chambers on each side of the thinner portion 30 would also be at distinct pressures and distinct temperatures, however, as explained below, the problem that is to be solved by this invention would not be as pronounced at the thinner portion 30, simply because it is thinner.

As shown in FIG. 1 schematically, there may be thermal expansion such as shown in outline at 36 at the thicker portion 34 due to the temperature imbalance between chambers 38 and 40.

As can be seen in FIG. 2, the higher pressure and higher temperature on the inner side of the thicker portion 34 causes a heat gradient across the width of the thicker portion 34. The same would be generally true at the thinner portions, however, since the thinner portions are in fact thinner, it is more likely that the temperature gradient will be not as pronounced, and heat would transfer freely across the width of the wrap. At the thicker portion, there is greater heat resistance, and thus a greater likelihood that the heat would not transfer across the entirety of the width 34, but would instead result in localized thermal expansion. This is the thermal expansion shown schematically and in dotted line at 36 in FIG. 1. When this type of expansion occurs, undesirable effects such as surface wear or galling between the end of the thicker portion 34 and the opposed base 24 of the orbiting scroll 22 can occur. This is, of course, undesirable.

SUMMARY OF THE INVENTION

In the disclosed embodiment of this invention, a recess is formed into the face of the thicker portion of the wrap such that localized thermal expansion is partially compensated, but not to the extreme edge such that this refrigerant in the recess is still separated from the suction chamber. In addition, discharge temperature and pressure refrigerant is communicated along the width of the thicker portion. Thus, the recess communicates the higher pressure and temperature refrigerant along the width of the thicker portion such that the heat gradient is only over a thin portion of the wrap, thus reducing the thermal expansion imbalance.

In a preferred embodiment, this recess is very shallow, and on the order of 0.0005 inch. Moreover, the recess extends between two circumferential edges, and to an inner edge. The recess preferably communicates with the discharge pressure chamber along the entirety of its circumferential width, to maximize the resistance to a heat transfer gradient.

These and other features of the present invention may be best understood from the following specification and drawings, the following of which is a brief description.

DETAILED DESCRIPTION OF A PREFERRED EMBODIMENT

Figure 3:
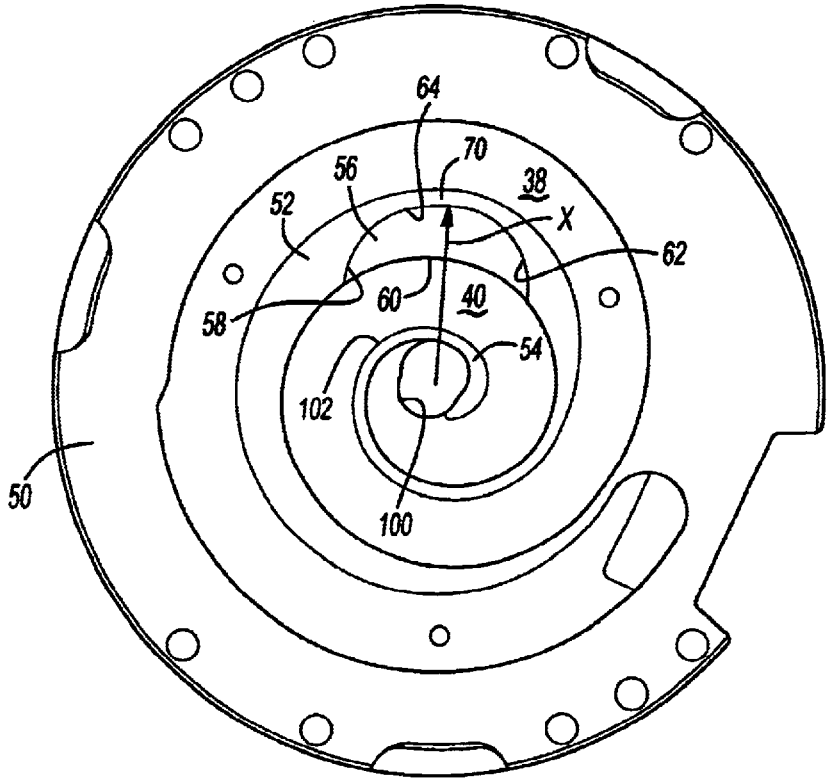
FIG. 3 is an end view of an inventive scroll compressor component.

FIG. 3 shows a non-orbiting scroll member 50 incorporating the present invention. As shown, a thicker portion 52 of the wrap is provided with a recess 56. The thinner portion 54, and other thinner portions do not receive such a recess. While a single recess is shown, a worker in this art would recognize that more than one recess could be utilized spaced throughout the thicker portions.

Figure 1:
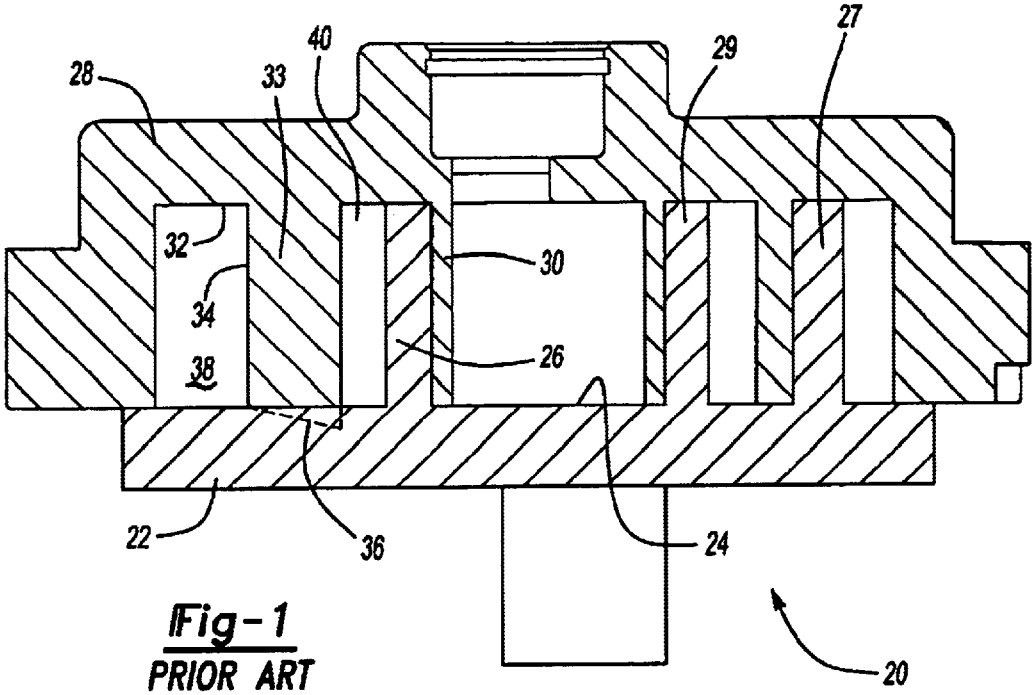
Fig-1 PRIOR ART
FIG. 1 is a cross-section through a prior art scroll compressor.
Figure 2:
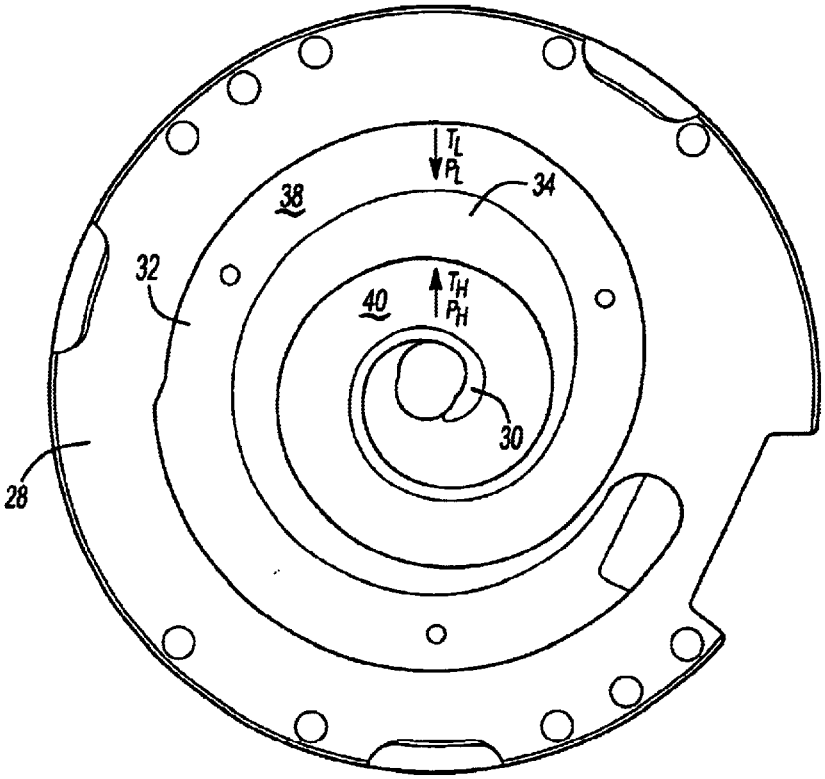
Fig-2 PRIOR ART
FIG. 2 is an end view of one portion of a prior art scroll compressor.

An inner circumferential extent 58 defines the recess 56 along with an outer circumferential extent 62. A back wall 64 seals the recess 56 from the suction chamber 38. The front end 60 of the recess 56 allows flow of refrigerant from chamber 40 throughout the recess 56. This higher temperature refrigerant will thus serve to reduce any thermal gradient along the thicker width of the thicker portion 52. The recess itself will partially compensate the thermal expansion at 36 in FIG. 1.

Figure 4:
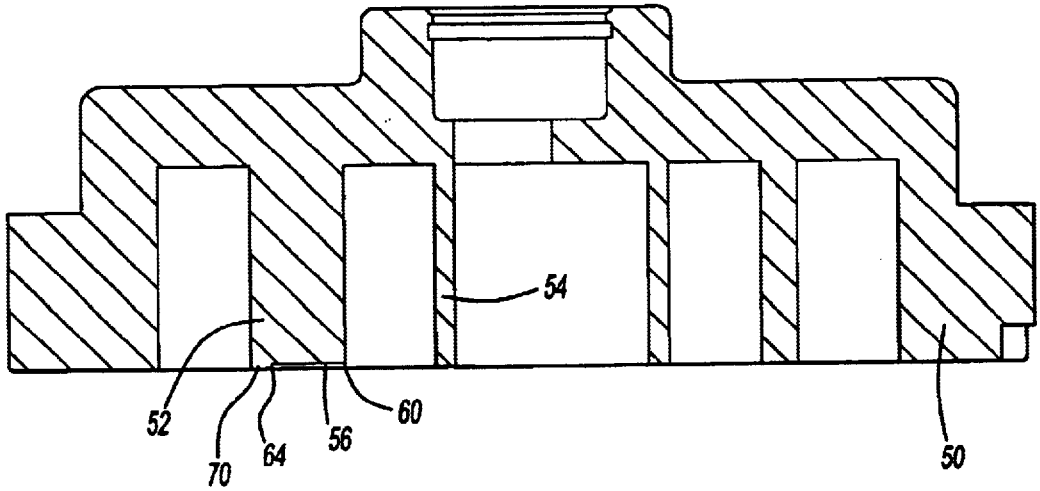
FIG. 4 is a cross-sectional view to the inventive scroll compressor component shown in FIG. 3.

As can be appreciated from FIGS. 3 and 4, the recess is formed in a portion of the wrap 52 which is spaced from a radially inner wrap portion along a line X extending from a discharge port 100, and through the recess. That is, the recess does not communicate with the discharge port, but instead is spaced radially outwardly of the discharge port when the wraps are engaged. Also as can be seen, line X passes through a thinner wrap portion 102 before reaching recess 56.

While a preferred embodiment of this invention has been disclosed, a worker of ordinary skill in the art would recognize that certain modifications would come within the scope of this invention. For that reason, the following claims should be studied to determine the true scope and content of this invention.

I claim:

1. A scroll compressor comprising:

a first scroll member having a base and a generally spiral wrap extending from said base, said generally spiral wrap being a "hybrid" type such that the thickness of the wrap throughout a circumferential length varies, with said wrap having a generally thicker portion and a generally thinner portion;

a second scroll member having a base and a generally spiral wrap extending from said base, said generally spiral wrap being a "hybrid" type having a thicker and thinner portion;

said second scroll member having its wrap interfit with said wrap of said first scroll member to define compression chambers, and said second scroll member being driven to orbit relatively to said first scroll member to cause said compression chambers to be reduced in volume, thereby compressing an entrapped refrigerant; and a recess formed into said thicker portion of said wrap of at least one of said first and second scroll members, said recess communicating with a radial inward face of said thicker portion of said wrap to communicate to a higher pressure compression chamber, and said recess being closed to block flow of refrigerant throughout the length of said thicker portion, such that said recess does not extend to a radially outer face of said thicker portion which would communicate with a lower pressure compression chamber, and there being a discharge port extending through said first scroll member, said recess not communicating with said discharge port when said wraps of said first and second scroll member interfit.

2. A scroll compressor as recited in claim 1, wherein said first scroll member receives said recess.

3. A scroll compressor as recited in claim 1, wherein said recess is relatively shallow.

4. A scroll compressor as recited in claim 1, wherein said recess is less than 0.01 inch.

5. A scroll compressor as recited in claim 1, wherein said recess extends between two circumferential edges, with a curve connecting said two circumferential edges, and defining a back wall for blocking flow of refrigerant to said lower pressure chamber.

6. A scroll compressor as set forth in claim 1, wherein said recess is formed in a thicker portion of said wrap, with a radially inner wrap portion being spaced radially inwardly of said wrap, and on the same radial side of said discharge port as said thicker portion.

7. A scroll compressor as set forth in claim 1, wherein a line drawn from a center of said discharge port, through said recess, passes through a thinner portion of said wrap before reaching said recess.

8. A scroll compressor comprising:

a first scroll member having a base and a generally spiral wrap extending from said base, said generally spiral wrap being a "hybrid" type such that the thickness of the wrap throughout a circumferential length varies, with said wrap having a generally thicker portion at a radially outer location than at least a generally thinner portion spaced more radially inwardly;

a second scroll member having a base and a generally spiral wrap extending from said base, said generally spiral wrap being a "hybrid" type;

said second scroll member having its wrap interfit with said wrap of said first scroll member to define compression chambers, and said second scroll member being driven to orbit relatively to said first scroll member to cause said compression chambers to be reduced in volume, thereby compressing an entrapped refrigerant; and a recess formed into said thicker portion of said wrap of said first scroll member, said recess communicating with a radial inward face of said thicker portion of said wrap to communicate to a higher pressure chamber, and said recess being closed to block flow of refrigerant throughout the length of said thicker portion, such that said recess does not extend to a radially outer face of said thicker portion which would communicate with a lower pressure chamber, said recess extends between two circumferential edges, with a curve connecting said two circumferential edges, and defining a back wall for blocking flow of refrigerant to said lower pressure chamber.

9. A scroll compressor as set forth in claim 8, wherein said recess is formed in a thicker portion of said wrap, with a radially inner wrap portion being spaced radially inwardly of said wrap, and on the same radial side of said discharge port as said thicker portion.

10. A scroll compressor as set forth in claim 8, wherein a line drawn from a center of said discharge port, through said recess, passes through a thinner portion of said wrap before reaching said recess.

11. A scroll compressor as recited in claim 8, wherein said recess is relatively shallow.

12. A scroll compressor as recited in claim 11, wherein said recess is less than 0.01 inch.

* * * * *